United States Patent [19]

Spector

[11] Patent Number: 4,917,381

[45] Date of Patent: Apr. 17, 1990

[54] VARIABLE WEIGHT PLAY BALL

[76] Inventor: Donald Spector, 380 Mountain Rd., Union City, N.J. 07087

[21] Appl. No.: 349,414

[22] Filed: May 9, 1989

Related U.S. Application Data

[63] Continuation-in-part of Ser. No. 205,477, Jun. 18, 1988, Pat. No. 4,834,382.

[51] Int. Cl.[4] ..... A63B 41/00

[52] U.S. Cl. ..... 273/58 H; 273/58 BA; 273/DIG. 14; 273/DIG. 20; 273/65 EC

[58] Field of Search ..... 273/58 BA, 58 H, 58 R, 273/58 B, 58 F, DIG. 14, DIG. 20, 65 R, 65 EC

[56] References Cited

FOREIGN PATENT DOCUMENTS 390690 4/1933 United Kingdom ..... 273/58 BA

*Primary Examiner*—George J. Marlo
*Attorney, Agent, or Firm*—Michael Ebert

[57] ABSTRACT

A variable-weight play ball having an inflatable inner bladder of elastomeric material disposed with a non-stretchable outer casing of flexible material to create a water region therebetween. The outer casing is provided with a valved water inlet through which water is introduced into the water region in an amount which depends on the desired weight of the ball. The inner bladder is provided with an air passage stem terminating in an air-inlet valve sealed to the outer casing and accessible from the ball exterior, thereby making it possible to blow up the inner bladder to the degree necessary to cause the water in the region to become evenly distributed therein to create a spherical water layer pressed between the bladder and the casing, the thickness of the layer determining the weight and play characteristics of the ball.

7 Claims, 1 Drawing Sheet

Fig. 1.
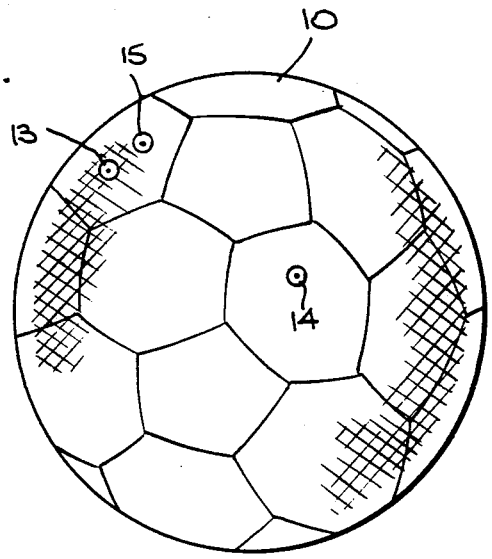
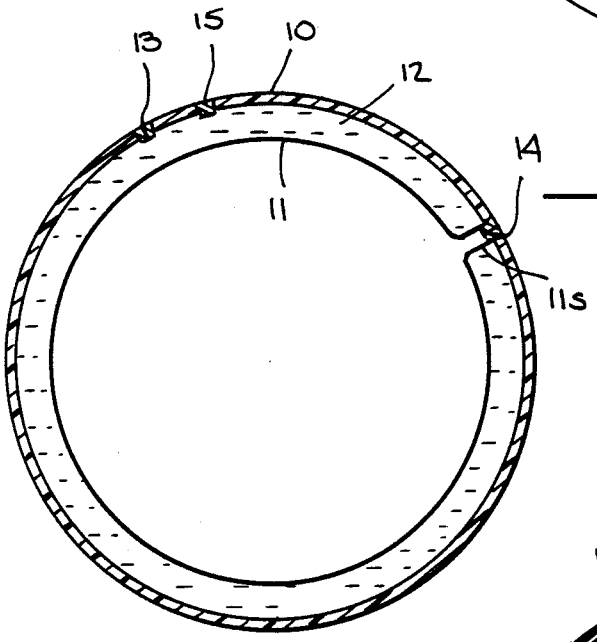
Fig. 2.
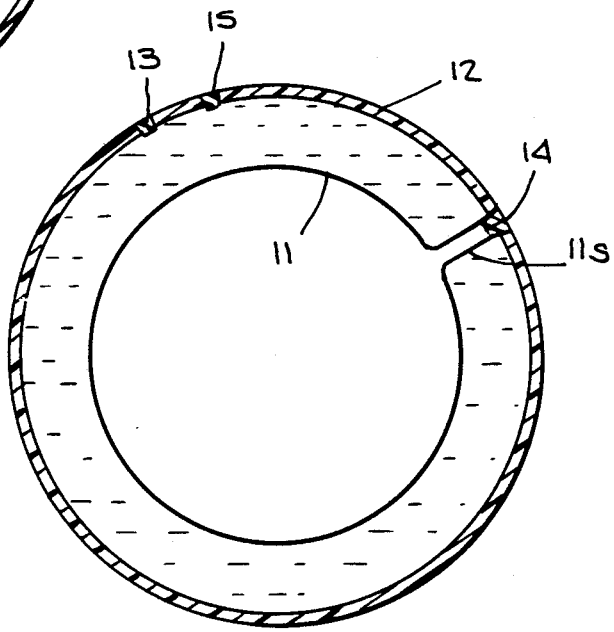
Fig. 3.

VARIABLE WEIGHT PLAY BALL

RELATED APPLICATION

This application is a continuation-in-part of my copending application Ser. No. 205,477, filed June 18, 1988, now U.S. Pat. No. 4,834,382, entitled "Inflatable Play Ball."

BACKGROUND OF INVENTION

1. Field of Invention:

This invention relates generally to play balls, and more particularly to a variable-weight ball whose weight, which is mainly determined by a spherical layer of water pressed between an inner bladder and an outer casing, is adjustable to impart desired play characteristics to the ball.

2. The State of the Art:

The typical inflatable beach ball of the type in common use at outdoor swimming pools and beaches is made from 6 to 8 mil polyvinyl film material, the ball being provided with a valved air inlet so that it can be inflated by mouth.

Such thin-skinned beach balls are usually made in a diameter greater than that of a basketball or soccer ball, and they are relatively very light in relation to their surface area. As a consequence, the typical light-weight beach ball offers a much greater surface area to air than smaller balls, and little resistance to wind deflection, so that the ball cannot be thrown very far, and on a windy day it is almost impossible to play with a beach ball.

Because even a light wind deflects the beach ball, when the ball is thrown from one player to another, it is more likely to land in the water rather than in the hands of a player, and when blown into the water, the ball may be propelled to a distant point from which it cannot readily be recovered. Children often lose beach balls because of wind conditions.

But apart from the difficulty of playing with a light-weight play ball under windy conditions is that its lack of weight imposes other limitations on the ball. Thus so-called medicine balls are as large as beach balls, yet are useful for body building, weight hurdling and other conditioning exercises for which a light-weight beach ball is unsuited. On the other hand, a medicine ball, which is a heavy, stuffed leather-covered ball, is expensive; it cannot be collapsed and stored in a compact state; hence it is altogether unsuitable for casual beach use.

The above-identified copending application discloses a pneumatic play ball having an outer casing formed of non-stretchable material which when fully expanded assumes a ball configuration. Within the casing is an inflatable balloon whose stem initially projects through a small port in the casing. When the balloon is inflated, it expands to engage and conform to the inner surface of the casing, after which the stem is tied and pushed within the port whereby the balloon is then fully encased in the casing.

While a ball of the type disclosed in my copending application has distinct advantages over conventional beach balls, it is still lacking in weight and subject to wind deflection.

Inasmuch as the present invention is realized in a spherical ball having an inner bladder and an outer casing between which is a water-filled region, the U.S. Pat. No. 3,517,933 to Malkin is pertinent to the extent that it discloses a ball formed by inner and outer shells having liquid in the space between the shells. Also pertinent for the same reason is the U.S. Pat. No. 3,655,197 to Milbaum. But neither patent discloses a ball which is inflatable in the manner of the present invention and whose weight is variable.

SUMMARY OF INVENTION

In view of the foregoing, the main object of this invention is to provide a variable-weight play ball whose weight, which is mainly determined by a layer of water interposed between an inner bladder and an outer casing, is adjustable to impart desired play characteristics to the ball.

A significant feature of the invention is that the weight of the ball may be adjusted to a degree which causes the ball to resist deflection by even strong winds, so that the ball may be used as a beach ball under windy conditions.

Another important advantage of the invention is that the weight of the ball may be reduced to a degree which causes the ball to behave as a very light-weight, easily thrown beach ball comparable to a conventional beach ball, in which case the ball is suitable for play by young children under minimal wind conditions.

Yet another advantage of the invention is that the weight of the ball may be increased to a degree which causes the ball to behave in a manner comparable to a medicine ball; hence the ball is then suitable for body building and other conditioning exercises. But unlike a medicine ball, a ball according to the invention may be collapsed into a compact form suitable for shipment and storage.

Also an object of this invention is to provide a variable weight play ball in which weight is imparted thereto by a layer of water which is uniformly and symmetrically distributed throughout the ball regardless of the thickness of the layer, whereby the play characteristics of the ball are comparable to those of conventional heavy balls of high quality.

Still another object of this invention is to provide a variable-weight ball which may be manufactured and sold at low cost.

Briefly stated, these objects are attained in a variable-weight play ball having an inflatable inner bladder of elastomeric material disposed within a non-stretchable outer casing of flexible material to create a water region therebetween. The outer casing is provided with a valved waterinlet through which water is introduced into the water region in an amount which depends on the desired weight of the ball. The inner bladder is provided with a valved air inlet which projects through the outer casing and is accessible from the ball exterior, thereby making it possible to blow up the inner bladder to the degree necessary to cause the water in the region to become evently distributed therein to create a spherical water layer pressed between the bladder and the casing, the thickness of the layer determining the weight and play characteristics of the ball.

BRIEF DESCRIPTION OF DRAWINGS

For a better understanding of the invention as well as other objects and further features thereof, reference is made to the following detailed description to be read in conjunction with the accompanying drawings, wherein:

FIG. 1 is a perspective view of a variable-weight play ball in accordance with the invention;

FIG. 2 is a diametrical section taken through the ball when a medium weight is imparted thereto; and FIG. 3 is a diametrical section taken through the ball when a heavy weight is imparted thereto.

DESCRIPTION OF INVENTION

Referring now to the drawing, a variable-weight spherical play ball in accordance with the invention includes an outer casing 10 formed of polyvinyl, polypropylene or other substantially non-stretchable, flexible film material of at least 6 mils in thickness. In practice, the casing, which is water-impermeable, may be formed in the manner of basketballs of contoured pieces which are sealed together. The diameter of casing 10 may be made equivalent to that of a conventional beach ball or even greater. And the casing may also be made of laminated or reinforced plastic film material of high strength.

Disposed within casing 10 is an inflatable inner bladder 11 formed of elastomeric material such as rubber or neoprene, the dimensions of the bladder being such that it can be blown up to assume a spherical form which can be expanded to a diameter at least as great as that of the outer casing. Interposed between inner bladder 11 and casing 10 is a spherical region 12 whose depth or thickness depends on the diameter of the inner bladder, and hence is adjustable. This region is fillable with water to create a water layer which is pressed by the inflated inner bladder against the interior surface of the outer casing and serves to impart weight to the ball whose poundage is a function of the thickness of the layer.

Outer casing 10 is provided with a valved water inlet 13 for introducing water into region 12. The valve is provided with a spring-biased valve element which when manually actuated opens the valve to admit water into the inlet, and which when released, automatically shuts off the valve. Hence when one wishes to collapse the ball, the valved water inlet is opened to permit the discharge of the water from the water region.

Inner bladder 11 is provided with an air-passage stem 11S terminating in a valved air inlet mounted on the outer casing 10 and peripherally sealed thereto so that it is accesible from the exterior of the ball to permit inflation of the bladder by mouth or by a pump in the fashion of a balloon. The valve of this inlet also includes a spring-biased valve element which when manually actuated is caused to open, and when released automatically shuts off the valve. Casing 10 also includes a venting valve 15 to permit the escape of air from region 12 when the inner bladder is being inflated. The valves in the air and water inlets may be of the types used in conventional inflatable balls or on pneumatic tires.

When, therefore, one wishes to provide a spherical play ball which is heavily weighted, as shown in FIG. 2, one first blows air through air inlet 14 to inflate inner bladder 11 to a diameter which is somewhat less than the diameter of the outer bladder. In practice, the inner bladder may be formed of colored elastomeric material and the outer casing of transparent material so that the degree to which the inner bladder is inflated within the casing is clearly visible. When the inner bladder is being inflated through the air inlet valve, the valve in the water inlet (or the vent valve) must be open to permit the escape of air from region 12.

Then water is introduced into region 12 through the valve water inlet 13 in an amount imparting to the ball the desired weight. Finally, the inner bladder is further inflated with air to cause the water in the region to be uniformly distributed throughout the region and to expel all air therefrom to create a spherical water layer that is pressed by the inflated inner bladder against the interior surface of the casing.

Should one wish to produce a somewhat lighter weighted ball, as shown in FIG. 3, then a smaller amount of water is introduced into region 12 to create a thinner layer of water, the air and water filling procedures for this purpose being the same as that previously described. But if one wishes to create a very light beach ball that can be readily thrown by a small child, then no water is introduced into region 12 and the inner bladder is inflated so that the inner bladder abuts the inner surface of the casing. Hence the ball is adjustable in a range whose lower limit is represented by the absence of water in region 12 which is then effectively deleted, to an upper limit in which the water layer in region 12 is of maximum thickness.

Since the outer casing is transparent, color may be imparted to the ball by adding a dye to the water. To impart greater weight to the ball, an oil may be used in lieu of water, the oil, because of its viscosity, imparting different play characteristics to the resultant ball.

Thus a variable-weight ball in accordance with the invention has many practical uses, for it can function as an ordinary light-weight beach ball, in which case it is subject to deflection by wind but is very easy to throw. It can be weighted to an extent minimizing wind deflection, or it can be weighted to a greater extent to render it usable in the manner of a medicine ball for conditioning exercises. But regardless of the degree to which the ball is weighted, it can be collapsed for storage and shipment.

While there has been shown and described a preferred embodiment of a variable weight play ball in accordance with the invention, it will be appreciated that many changes and modifications may be made therein without, however, departing from the essential spirit thereof.

I claim:

1. A variable-weight spherical play ball comprising:

A. a non-stretchable outer casing formed of flexible, liquid-impervious material and having a predetermined diameter;

B. an inflatable inner bladder disposed within said casing formed of elastomeric material to define with the casing a spherical region therebetween whose volume depends on the extent to which the inner bladder is stretched by inflation;

C. a valved liquid inlet mounted on said casing to permit the introduction of liquid into said region in an amount imparting a desired weight to the ball; and D. a valved air inlet mounted on said bladder, the air inlet projecting through said casing and being peripherally sealed thereto to provide access to said inner bladder from the exterior of the ball, thereby by inflating the inner bladder with air, the liquid introduced to said region is then caused to become uniformly distributed throughout the region to create a spherical layer that is pressed by the inner bladder against the interior surface of the casing, said layer having an outer diameter determined by the diameter of the casing and a thickness determined by the amount of liquid therein.

2. A ball as set forth in claim 1, wherein said casing is formed of polyvinyl plastic film material.

3. A ball as set forth in claim 1, wherein said bladder is formed of rubber.

4. A ball as set forth in claim 1, wherein said casing is of transparent material.

5. A ball as set forth in claim 4, wherein said bladder is of colored material and is visible through said casing.

6. A ball as set forth in claim 1, further including a venting valve on said casing to permit the escape of air from said region as said bladder is being inflated.

7. A ball as set forth in claim 1, having the diameter substantially equivalent to that of a conventional beach ball and greater than that of a standard basketball.

* * * * *